US006237769B1

(12) United States Patent
Collom

(10) Patent No.: US 6,237,769 B1
(45) Date of Patent: May 29, 2001

(54) DEVICE TO PROTECT LIGHT STRINGS FOR STORAGE

(75) Inventor: Dewaine F Collom, Magnolia, TX (US)

(73) Assignee: Lightsock, Inc., Magnolia, TX (US)

( * ) Notice: Subject to any disclaimer, the term of this patent is extended or adjusted under 35 U.S.C. 154(b) by 0 days.

(21) Appl. No.: 09/520,524

(22) Filed: Mar. 8, 2000

(51) Int. Cl.[7] ..... B65D 85/42
(52) U.S. Cl. ..... 206/419; 206/388; 248/317
(58) Field of Search ..... 206/388, 408, 206/410, 418–422, 702; 248/317, 320; 362/227, 234, 249

(56) References Cited

U.S. PATENT DOCUMENTS 2,741,411 * 4/1956 Olden ..... 206/422
2,872,032 * 2/1959 West ..... 206/419
5,033,619 * 7/1991 Garis ..... 206/419
5,064,067 * 11/1991 McAllister et al. ..... 206/420
5,287,965 * 2/1994 Miller ..... 206/420
5,381,899 * 1/1995 Rabbitt ..... 206/419
5,582,291 * 12/1996 Schroeder et al. ..... 206/419
5,653,339 * 8/1997 Dobson ..... 206/420
5,676,250 * 10/1997 Walters ..... 206/419
5,868,334 * 2/1999 Cedillo ..... 206/420
5,924,570 * 7/1999 Sickles ..... 206/419
5,947,298 * 9/1999 Huang ..... 206/420

* cited by examiner

*Primary Examiner*—Jim Foster
(74) *Attorney, Agent, or Firm*—R. Perry McConnell

(57) ABSTRACT

The invention is a device for quickly and easily protecting decorative light strings, such as Christmas lights, for storage. The stored light strings are protected against damage, and are immediately ready for re-use without tangling.

7 Claims, 1 Drawing Sheet

DEVICE TO PROTECT LIGHT STRINGS FOR STORAGE

FIELD OF THE INVENTION

The invention concerns a device for preparing light strings, such as Christmas lights, for tangle-free storage and easy re-use.

BACKGROUND OF THE INVENTION

Decorative light strings are used in a wide variety of applications, such as non-seasonal store displays. One of their widest uses is as Christmas lights, when they are used to decorate yards, fences, and houses and other structures. However, this seasonal use of such light strings requires that the light strings be stored for much of the year. In storage, the light strings tend to become tangled, resulting in wasted time involved in untangling the light strings before they can be re-hung as Christmas approaches. The tangling can become so severe that the light string must be thrown away as unusable. These tangling problems are more severe with newer, and very popular, light strings such as icicle lights.

To provide a solution to the tangling and storage problem, various devices for storing light strings have been suggested. These devices often involve a flat card or base around which the light string must be meticulously wound. For example, U.S. Pat. No. 5,317,491 to Lee discloses a flat, stiff mounting plate with integrated, uniformly-spaced slotted tabs, allowing for the light string wire to be wound around the plate and the lights to be inserted into the slots.

Similarly, U.S. Pat. No. 5,526,931 to White discloses a slotted base card with swivel-pivots, so that the card may be axially rotated to wind and un-wind the light string on the card. In White, slots in the card do not hold individual sockets. Rather, they provide saddles for the wire to fit into to prevent its slipping off of the card. White additionally discloses integrated holes in the card to allow the card to be hung on hooks for storage. However, the light string must be wound onto the card manually, and must be unwound for re-use.

U.S. Pat. No. 5,064,067 to McAllister, et al., discloses a generally rectangular frame around which a light string can be would, with tooth-like projections at the edges of the frame to prevent the wire from slipping. Unlike White, the teeth of the device disclosed in McAllister, et al. are narrowly spaced, and require that the light string be wound with only one loop between each pair of teeth. Thus the light string must be carefully wound about the frame to utilize each available gap and avoid wasting space. The device of McAllister, et al., additionally discloses the use of an integral hook to hang the frame for storage. As with the device of White, the light string must be manually wound and un-wound from the frame.

Each of these devices provides some means for storing light strings, but each requires effort on the user's part to properly wind the light string about the device, and in some cases, to insert individual light sockets into slots. Further, these devices do not provide protection for multiple, dangling, sub-strings, such as those found on icicle lights. Accordingly, it is desirable to provide a device to allow consumers to quickly and easily prepare light strings for storage in a way which prevents tangling and protects the lights against breakage.

It is a goal of the invention to provide a device to quickly prepare light strings for storage.

It is a further goal of the invention to allow light strings to be quickly removed from storage and to be prepared for re-hanging.

It is another goal of the invention to protect light strings against breakage and tangling while in storage.

SUMMARY OF THE INVENTION

The invention provides a device for rapidly enclosing a light string in an extensible sheath, such as a flexible lightweight plastic tube. Once it is so enclosed, the light string may be coiled, un-coiled, and re-coiled without becoming tangled. Such an enclosed light string may be stored by laying it down or hanging it on the wall in a coil. The enclosure of the light string in a plastic tube provides some protection against breakage during storage. Additional protection can be provided by placing the enclosed light string in a box, such as a cardboard box, from which the enclosed light string can be quickly removed and prepared for re-use.

The invention comprises a base unit and an extensible sheath, each having a longitundinal axis, with the base unit inserted through the sheath in its compressed form so that their longitudinal axes are essentially aligned. The base unit additionally comprises a coupler capable of securely holding one end of the light string to be stored. In operation, one end of the light string is attached to the coupler so that the sheath may be extended to surround and protect the length of the light string. Depending on the positioning of the coupler, a short portion of the light string may be left uncovered until the light string is decoupled from the base unit and the sheath is extended further to cover this final portion. The invention preferably comprises a restraint which can be used to hold the base unit in position while the sheath is being extended, so that a single person can perform the entire process of enclosing the light string.

In the preferred embodiment, the base unit comprises flared ends to prevent the sheath from slipping off of the base unit prematurely. Also in the preferred embodiment, one of the ends of the base unit is removably attachable to the base unit, so that the removable end may be used as a guide to direct the light string into the sheath. The base unit further preferably comprises depressions or slots, into which fasteners such as rubber bands or strips tightenable with Velcro™ may be seated over the ends of the extensible sheath to further prevent unwanted slippage of the extensible sheath.

DETAILED DESCRIPTION OF THE PREFERRED EMBODIMENT

Figure 1A:
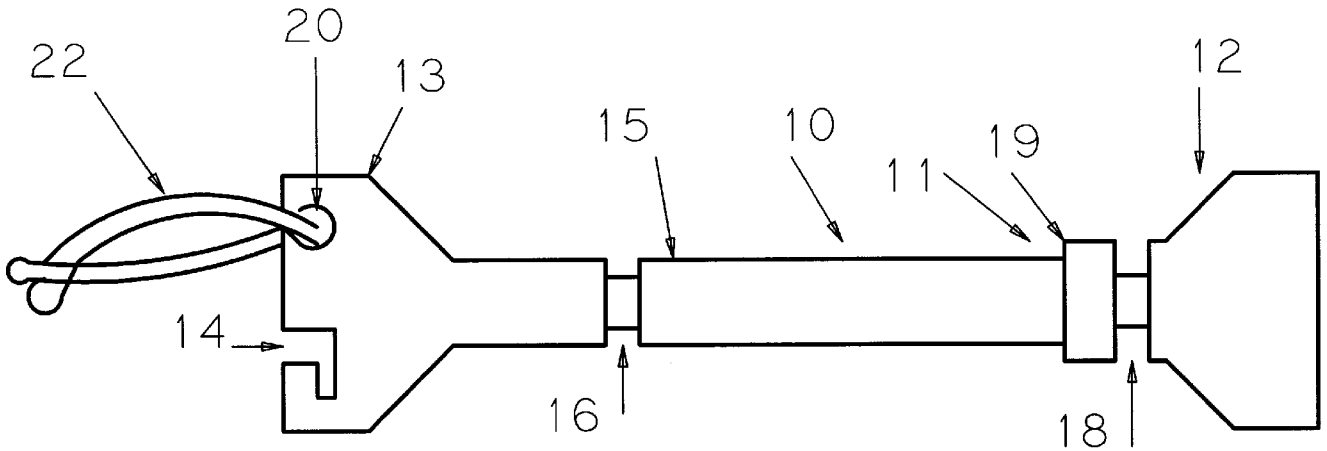
FIG. 1A is side view of the preferred embodiment of the invention, without the extensible sheath in place.
Figure 1B:
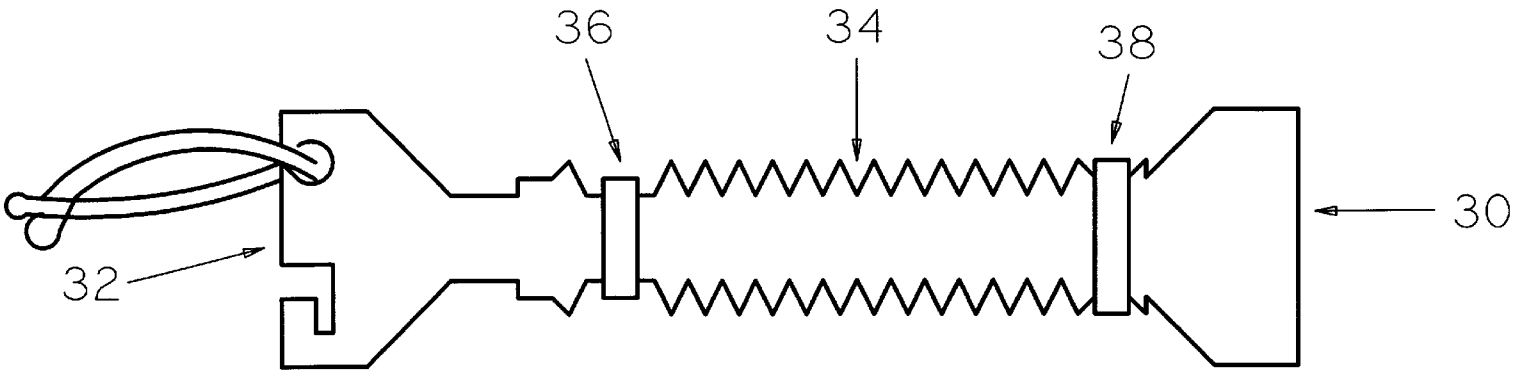
FIG. 1B is side view of the preferred embodiment of the invention, with the extensible sheath in place.

Referring to FIGS. 1A and 1B, the invention comprises a base unit 10, having a first end 11 and a second end 13. In the preferred embodiment, the base unit 10 comprises a base unit body 15, and the first end 11 of the base unit 10 comprises a removable first sleeve 12. The base unit body 15 may comprise either a hollow tube or a solid body.

A coupler 14 allows one end of the light string (not shown) which is to be covered to be restrained by securing it in the coupler 14. If the base unit body 15 is hollow, the end of the light string to be secured may be fed into the opening 30 at the first end 11 of the base unit 10, through the base unit 10, and out of the opening 32 at the second end 13 of the base unit 10, where it is inserted into the coupler 14.

Alternatively, the first removable sleeve may be removed from the base unit body 15, and the end of the light string may be fed into the opening 30 at the first end 11, through the first removable sleeve 12, and along the outside of the base unit body 15 to be secured in the coupler 14. The coupler 14 is preferably a slot, to allow the electrical plug on the end of the light string to be captured and held securely. However, those of skill in the art will recognize that other couplers, such as spring clips or ties which may be securely fastened to the base unit body 15, will also work effectively.

Those of skill in the art will recognize that variations of this arrangement are possible. If the base unit body 15 is a solid, rather than a hollow, body the coupler 14 could be placed at or near the first end 11 of the base unit 10, and the light string attached there rather than extending through or along the base unit 10.

The removable first sleeve 12 is preferably attached to the base unit 10 by means of a slip-on collar 19, which allows the removable first sleeve 12 to be readily placed on or taken off of the base unit body 15. The base unit 10 may also comprise slots 16 and 18 which allow the extensible sheath 34 to be restrained by means of removable holders 36 and 38 which loop around the outside of the extensible sheath 34 and seat into slots 16 and 18. Those of skill in the art will recognize that removable holders 36 and 38 may be comprised of various available products, such as rubber bands or cloth strips whose ends are tightened together with Velcro™. Slot 18 is preferably located on removable first sleeve 12 so that removable first sleeve 12 can be used as a guide to extend the extensible sheath 34 along the length of the light string.

The invention also preferably comprises a restraint 22, such as a looped lanyard, which is attachable to the second end 13 of the base unit 10 by looping it though a hole 20. The restraint 22 may be secured to a doorknob or any other securely stationary object to hold the base unit 10 in position while the extensible sheath 34 is being extended to cover the light string, thereby allowing a single person to easily complete the task of covering the light string.

In operation, a user would remove the first removable sleeve 12 from the base unit 10 and slide the extensible sheath 34 into position around the first removable sleeve 12, securing the extensible sheath 34 to the first removable sleeve 12 by use of removable holder 38. The user will feed the end of the light string to be protected through the opening 30 in the first end 11 of the base unit 10, through the first removable sleeve 12, secure it into the coupler 14. The user will then slide the extensible sheath 34 over the base unit body 15 and secure the extensible sheath 34 to the base unit body 15 with removable holder 36.

The user will then secure the restraint 22 to a doorknob or other securely stationary object, remove the first removable sleeve 12 from the base unit 10, and walk down the length of the light string, using the first removable sleeve 12 as a guide to direct the light string into the extensible sleeve 34, which will extend along with the first removable sleeve 12 because: it is secured by removable holder 38. When the entire length of the light string is enclosed, the first removable sleeve 12 is released from the extensible sheath 34 by removing removable holder 38. The light string is then released from coupler 14 and the extensible sheath 34 is extended an additional distance until the end of the light string is clear of the base unit body 15 and fully enclosed by the extensible sheath 34. If necessary, the extensible sheath 34 can then be cut, and any remainder still on the base unit body 15 will be available for further use, or the entire remainder of the extensible sheath 34 can be removed from the base unit body 15.

I claim:

1. A device for use in covering light strings, comprising a base unit having a first end and a second end, an extensible sheath, wherein said extensible sheath is releasably restrained on said base unit, and a coupler integrable with said base unit, wherein said coupler is attachable to an end of a light string.

2. The device of claim 1, wherein said device for covering light strings additionally comprises a restraint, wherein said restraint is attachable to said base unit and useable to hold said base unit securely in position during use.

3. The device of claim 1, wherein said coupler comprises a slot formed in said base unit.

4. The device of claim 1, wherein said base unit comprises a tube.

5. The device of claim 1, wherein said base unit comprises a solid body.

6. The device of claim 1, wherein said first end comprises a first removable sleeve which is removably attachable to the remainder of said base unit.

7. The device of claim 6, wherein said extensible sheath is removably attachable to said first removable sleeve.

* * * * *